US009534549B2

(12) United States Patent
Costa-Patry et al.

(10) Patent No.: US 9,534,549 B2
(45) Date of Patent: Jan. 3, 2017

(54) METHOD AND DEVICE FOR PURGING A FUEL TANK

(71) Applicant: IAV GmbH Ingenieurgesellschaft Auto und Verkehr, Berlin (DE)

(72) Inventors: Etienne Costa-Patry, Berlin (DE); Michael Knieling, Berlin (DE)

(73) Assignee: AUDI AG, Ingolstadt (DE)

( * ) Notice: Subject to any disclaimer, the term of this patent is extended or adjusted under 35 U.S.C. 154(b) by 264 days.

(21) Appl. No.: 14/521,483

(22) Filed: Oct. 23, 2014

(65) Prior Publication Data

US 2015/0114362 A1 Apr. 30, 2015

(30) Foreign Application Priority Data

Oct. 29, 2013 (DE) ..... 10 2013 017 934

(51) Int. Cl.
*F02D 41/00* (2006.01)
*F02D 17/04* (2006.01)
*F02M 25/08* (2006.01)

(52) U.S. Cl.
CPC ..... *F02D 41/0032* (2013.01); *F02D 17/04* (2013.01); *F02D 41/004* (2013.01); *F02M 25/0836* (2013.01); *F02M 25/0854* (2013.01)

(58) Field of Classification Search
CPC .... F02D 17/04; F02D 41/0032; F02D 41/004; F02D 41/003; F02M 25/0836; F02M 25/0854; F02M 25/08; F02M 2025/0845; F02M 25/0872; F02M 25/089; F02M 35/0218; F02M 35/10222
USPC ..... 123/516, 518–521; 701/112; 137/587, 137/588, 589
See application file for complete search history.

(56) References Cited

U.S. PATENT DOCUMENTS

| | | | |
|---|---|---|---|
| 6,382,191 | B1 | 5/2002 | Curran et al. |
| 2002/0096137 | A1 | 7/2002 | Kobayashi et al. |

FOREIGN PATENT DOCUMENTS

| | | | |
|---|---|---|---|
| DE | 69109516 | T2 | 9/1995 |
| DE | 10035125 | A1 | 1/2002 |
| DE | 10138280 | A1 | 4/2002 |
| DE | 10200016 | A1 | 10/2002 |
| DE | 102004021387 | A1 | 11/2005 |
| DE | 10201889 | B4 | 3/2010 |
| DE | 102010053665 | A1 | 8/2011 |
| EP | 0444517 | B1 | 9/1991 |

*Primary Examiner* — Erick Solis
*Assistant Examiner* — Carl Staubach
(74) *Attorney, Agent, or Firm* — Leydig, Voit & Mayer, Ltd.

(57) ABSTRACT

A method for purging a fuel tank includes providing a three-way valve connected to the fuel tank via a first purging line, connected to a second purging line opening into a suction duct and connected to a third purging line opening into an adsorption container. A first path can be released in the three-way valve, based on the pressure inside the fuel tank exceeding a first predetermined opening pressure inside the fuel tank and the engine being in operation, such that the fuel vapors are caused to be purge out of the fuel tank into the suction duct. A second path can also be released in the three-way valve, based on the pressure inside the fuel tank exceeding a second predetermined opening pressure inside the fuel tank and the engine being not in operation, such that the fuel vapors are caused to be purged out of the fuel tank into the adsorption container.

6 Claims, 3 Drawing Sheets

METHOD AND DEVICE FOR PURGING A FUEL TANK

CROSS-REFERENCE TO PRIOR APPLICATION

Priority is claimed to German Patent Application No. DE 10 2013 017 934.3, filed on Oct. 29, 2013, the entire disclosure of which is hereby incorporated by reference herein.

FIELD

The invention relates to a method for purging a fuel tank which stocks fuel for an internal combustion engine and to a device for purging a fuel tank which stocks fuel for an internal combustion engine.

BACKGROUND

In a fuel tank, fuel vapours form in the volume of the tank which is not filled up by liquid fuel. These fuel vapours represent potential emissions, which pursuant to various legal regulations must not be released into the environment, and thus must not leave the closed fuel system in an uncontrolled manner. The formation of the fuel vapours is influenced by temperature fluctuations, which are brought about both by fluctuating ambient temperatures and by heated fuel which is fed back by the fuel supply system. As the temperature increases, the formation of fuel vapours increases, partly because the saturated vapour pressure of the fuel vapour increases, and leads to a pressure increase in the fuel tank above the ambient pressure. Since fuel tanks become more complex and thus more expensive with increasing pressure resistance, the pressure is to be limited by ventilating the fuel tank to an acceptable level. Conventional tank ventilations pass the fuel vapour/air mixture through a container, in which the volatile fuel components are applied to an adsorbent, generally activated carbon, and emit purified air to the environment. Aside from the pressure increase in the tank as a result of the rise in the temperature of the fuel, a large amount of fuel vapour/air mixture is displaced by inflowing fuel when the tank is refilled with fuel. This mixture is either passed through the same or a further activated carbon container (ACC) or sucked out through a suction system in the nozzle of the tank system. The activated carbon containers have a limited intake capacity, which depends on the adsorbency and the size of the container. Beyond this intake capacity, fuel vapours are passed through the ACC without being adsorbed, and are thus released into the environment. To prevent this, ACCs of this type have to be regenerated regularly, or independently of the used capacity thereof.

Published application DE 101 38 280 A1 discloses a device for controlling fuel vapour purging in a vehicle, a valve arrangement merely passing the fuel vapours in a first direction from the fuel tank to a device for buffering the fuel vapours, and merely passing the fuel vapours in a second direction counter to the first direction into a combustion engine from the device for buffering fuel vapours.

Patent specification EP 0 444 517 B1 discloses a self-diagnosis device in a system which prevents the spread of fuel evaporation gas, comprising a canister, connected to a fuel container, for adsorbing the fuel vapour, the canister being connected to the suction duct of an internal combustion engine via an outlet duct. An opening and closing means is arranged in the outlet duct. The device further comprises an air/fuel ratio sensing means for detecting an air/fuel mixture passed to the internal combustion engine and an abnormality assessment means. This controls the opening and closing means and detects changes in the air/fuel mixture when the outlet duct is open and closed. On this basis, an assessment is made as to whether a particular abnormality is present. The self-diagnosis device further comprises an evaporation gas production state detection means for detecting the existence of fuel vapour and a three-way valve having a first terminal connected to the fuel container, a second terminal connected to the canister, and a third terminal connected to the suction duct. In a first position of the three-way valve, the fuel container is connected to the canister, and in a second position, the fuel container is connected to the suction duct. The abnormality assessment means switches the three-way valve from the first to the second position, detects a change in the state of the fuel evaporation gas, and assesses whether the evaporation gas production state detection means is abnormal.

Published application DE 10 2004 021 387 A1 discloses an internal combustion engine comprising a suction line, a mechanical supercharger, and a throttle body close to the motor, a further throttle body being arranged upstream from a supercharger in the suction line and at least one underpressure line branching off in a region between the further throttle body and the supercharger.

Patent specification DE 102 01 889 D4 discloses a control/regulation system for automatically stopping and starting an engine of a vehicle, comprising a fuel tank, a canister for absorbing fuel vapour generated in the fuel tank and purging the absorbed fuel vapour into an air suction system of the engine, a pressure control/regulation portion for controlling/regulating the internal pressure of the fuel tank, an engine stop/start determination portion, the internal pressure being kept at a predetermined level lower than atmospheric pressure, and the engine stop/start determination portion preventing the engine from stopping when the internal pressure is higher than the predetermined level.

A drawback of the fuel vapour purging devices used in the art is that the fuel tank is purged constantly via the activated carbon container, meaning that said container has to be replenished regularly, worsening the durability of the ACC and increasing the chance of a breakout, in other words emission of fuel vapour to the environment.

SUMMARY

In an embodiment, the present invention provides a method for purging a fuel tank arranged in a motor vehicle. A three-way valve having first, second and third terminals is provided. The first terminal is connected to the fuel tank via a first purging line. The second terminal is connected to a second purging line which opens into a suction duct of an internal combustion engine disposed downstream from a throttle device. The third terminal is connected to a third purging line which opens into an adsorption container configured to adsorb fuel vapours. The adsorption container is connected to a fourth purging line which is lockable and which opens into the suction duct, and is further connected to an environment of the vehicle via a lockable ambient line so as to release air freed from fuel vapours and to receive ambient air. The pressure inside the fuel tank is determined by a unit configured to detect an internal fuel tank pressure of the fuel tank. A first path is released in the three-way valve, based on the pressure inside the fuel tank exceeding a first predetermined opening pressure inside the fuel tank and the internal combustion engine being in operation, such that the first and second terminals are connected and the fuel vapours are caused to be purged out of the fuel tank into the suction duct via the first and second purging lines. The first path is closed again based on the pressure inside the fuel tank falling below a first predetermined closing pressure inside the fuel tank. A second path is released in the three-way valve, based on the pressure inside the fuel tank exceeding a second predetermined opening pressure inside the fuel tank and the internal combustion engine being not in operation, such that the first and third terminals are connected and fuel vapours are caused to be purged out of the fuel tank into the adsorption container via the first and third purging lines. The second path is closed again based on the pressure inside the fuel tank falling below a second predetermined closing pressure inside the fuel tank.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
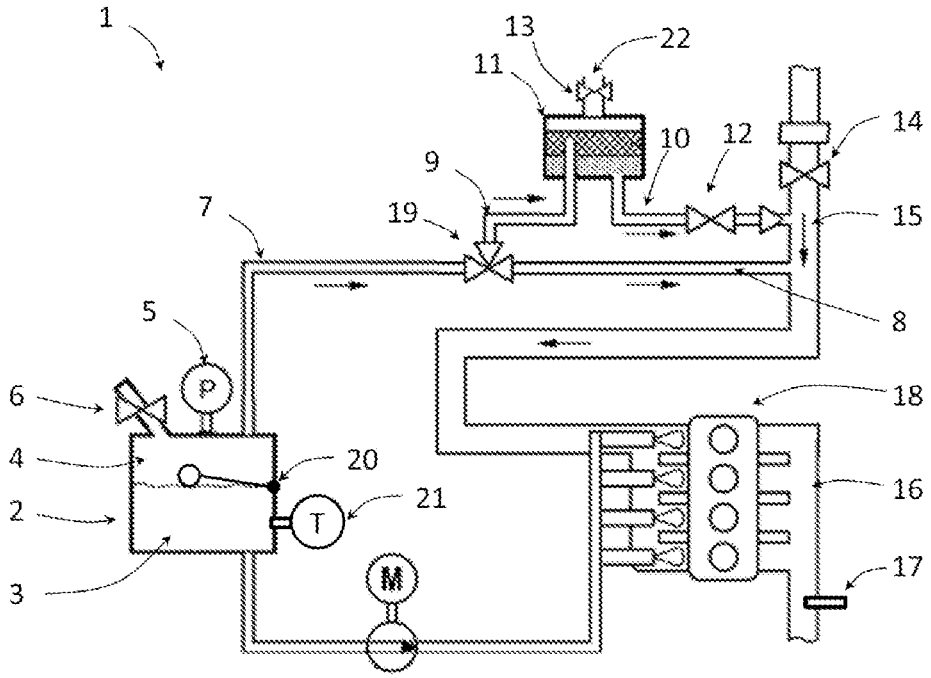
FIG. 1 is a schematic drawing of a fuel tank purging system according to an embodiment of the invention.

In an embodiment, the present invention provides a fuel tank purging which effectively prevents the emission of fuel vapours from a fuel system of a motor vehicle to the environment, targeted internal tank pressure control meaning that an adsorption chamber is only loaded with fuel vapour in exceptional cases. The aim of the method according to an embodiment of the invention is to minimise these exceptional cases, in other words not let them occur. Technically speaking, this is not possible in all extreme situations. Moreover, some legal requirements necessitate the presence of an adsorption container, and this is already sufficient reason for a method for replenishing the adsorption container.

An embodiment of the invention relates to a method for purging a fuel tank arranged in a motor vehicle. The motor vehicle is a conventional vehicle driven by combustion engine or preferably, but not exclusively, a hybrid vehicle, which has at least one internal combustion engine. Hybrid vehicles of this type are known and can be driven by the internal combustion engine, an electric motor or both at once. What is important for various embodiments of the invention is the presence of an internal combustion engine driven using fossil fuel, preferably petrol. The fuel is stored in the fuel tank. The fuel tank is integrated into a fuel system which needs effectively to prevent the escape of liquid and gaseous fuel, referred to in the following as fuel vapour. As a result of the formation of the fuel vapour, the pressure in the fuel tank can increase, meaning that the fuel tank is preferably formed as a pressure tank. In the following, a pressure tank is understood to be a fuel tank which can stably withstand a defined overpressure and underpressure. A possible configuration of a pressure tank of this type can receive pressures for example of −0.3 bar to 0.2 bar (relative to ambient pressure). It is technically readily possible to produce fuel tanks for larger underpressures and overpressures, but these involve higher production costs and also higher operating costs due to a higher weight. Pressure tanks of this type are needed primarily for use in hybrid vehicles, since conventional pressure compensation by way of fuel tank ventilation or purging can only take place in selected operating ranges of the internal combustion engine, for example low partial load or idling, and in hybrid vehicles the internal combustion engine is typically deactivated in these operating ranges. Thus, the fuel vapours have to remain in the tank longer, resulting in a higher pressure inside the fuel tank, or are filtered by way of additional means and emitted to the environment. Additional means of this type comprise adsorption containers, generally in the form of activated carbon containers. Since a breakout from the absorption container is to be prevented in all cases, it should be configured at a size which can accommodate sufficient fuel vapours in all situations. The adsorption containers have to be replenished from a particular loading level upwards, for example by purging with ambient air. The larger the adsorption container, the longer the purging process takes. However, since like the fuel tank purging this can only take place in particular operating ranges of the internal combustion engine, a larger adsorption container alone is not an acceptable measure for preventing the release of fuel vapours. Moreover, a larger adsorption container brings about higher production and operating costs.

The fuel tank used in the method according to an embodiment of the invention comprises a unit for detecting a pressure inside the fuel tank, referred to in the following as an internal pressure.

The fuel tank is connected to a first terminal of a three-way valve via a first purging line. The three-way valve in turn is connected to a second purging line via a second terminal. The second purging line opens into a suction duct of the internal combustion engine downstream from a throttle means. The suction duct passes combustion air into the internal combustion engine. The volume flow of the combustion air is usually set by way of the throttle means, also known as the throttle body. During idling and at a low load, the throttle means is almost closed, leading to a relatively large underpressure downstream from the throttle means. Combustion air is ambient air which is also present in the fuel tank as simple air. In the present specification, air is understood to be the usual composition of the atmosphere, which close to the ground consists of approximately 78% nitrogen and 21% oxygen as well as further gases such as argon, carbon dioxide and water vapour.

The three-way valve further comprises a third terminal, to which a third purging line is connected. This line opens into the adsorption container, which in turn is connected to the suction duct via a fourth purging line. The fourth purging line likewise opens into the suction duct downstream from the throttle means, and can preferably be sealed using a valve.

Equivalents to the three-way valve can also be used in another embodiment of the invention. Although the three-way valve is advantageous in relation to space requirements and arrangement and actuation options, separate barriers in the purging lines may also be provided in accordance with an embodiment of the invention.

The adsorption container further comprises an ambient line, which can be sealed using a valve and which is arranged in such a way that air flows out of the fuel tank through the adsorption container, the fuel vapours are adsorbed in the adsorption container, and purified air is emitted to the environment through the ambient line. Moreover, ambient air can flow into the adsorption container via the ambient line and take up adsorbed fuel vapour (desorption) and lead it out of the adsorption container via the fourth purging line towards the suction duct of the internal combustion engine.

The three-way valve can switch between three different positions so as to make two open paths and one blocked position possible. Three-way valves and the switching thereof using adjustment means are known and are not described in detail. The switching signals to the adjustment means may be emitted by a control means. However, it is also possible for the three-way valve to be connected directly to the fuel tank, the suction duct and/or the purging line via fluid lines, in such a way that pressure differences bring about switching of the adjustment means.

If the internal pressure exceeds a first specifiable fuel tank opening internal pressure, referred to in the following as the first opening pressure, and if the internal combustion engine is in operation, the three-way valve releases a first path. This path connects the first and the second terminal, resulting in a fluid connection between the fuel tank and the suction duct. In the simplest case, the first opening pressure is a predetermined threshold for the internal pressure, which is above a pressure in the suction duct downstream from the throttle means. The pressure in the suction duct can in turn be detected using a unit for detecting pressure, for example an absolute pressure sensor, or be determined by way of the operating state or the throttle body position, which is correlated with the operating state, in connection with the rotational speed of the internal combustion engine. It goes without saying that a control unit receives the signals of the absolute pressure sensor, a throttle body sensor and a rotational speed sensor and determines or calculates therefrom the operating state and/or the pressure in the suction duct and/or the resulting first opening pressure. Preferably, the control unit or a further control unit, as the aforementioned control means, controls the adjustment unit(s) of the three-way valve.

The detailed specification of the first opening pressure is disclosed below. In every case, the first opening pressure is selected in such way that the internal pressure is greater than the pressure in the suction duct, it also being possible for the internal pressure to be less than the ambient pressure. This brings about purging of the fuel tank. If the pressure in the fuel tank becomes too low, an underpressure valve may be arranged in the fuel tank, which opens at correspondingly low pressure, making it possible for ambient air to flow into the tank. However, this will generally not happen, since the three-way valve closes again first. This is because the first path is sealed again by the three-way valve as soon as the internal pressure falls below a first fuel tank closing internal pressure, referred to in the following as the first closing pressure. The terms 'exceeding' and 'falling below' correspond to the mathematical expressions 'greater than or equal to' and 'less than or equal to'. The first closing pressure is in every case selected in such a way that the internal pressure does not fall below a lower pressure limit, which is dependent on the construction and which ensures constant underpressure stability of the fuel tank. The aforementioned underpressure valve is merely formed as a safety valve which eliminates underpressure peaks as quickly as possible.

If the internal combustion engine is not in operation and if a second fuel tank opening internal pressure, referred to in the following as the second opening pressure, exceeds the internal pressure, the three-way valve releases a second path. This path connects the first and the third terminal, resulting in a fluid connection between the fuel tank and the adsorption container. In the simplest case, the second opening pressure is an absolute overpressure threshold for the internal pressure, causing the fuel vapours to be purged out of the fuel tank into the adsorption container via the first and the third purging line if the overpressure cannot be eliminated during operation of the internal combustion engine as disclosed above. If the internal pressure falls below a second fuel tank closing internal pressure, referred to in the following as the second closing pressure, the three-way valve closes the second path. The second closing pressure will be at least equal to, preferably greater than, the ambient pressure.

Advantageously, by specifying the first and second opening pressures and the first and second closing pressures appropriately, purging of the fuel tank is made possible which takes place regularly directly from the fuel tank into the suction duct. As a result, merely a small adsorption container is required, which is subject to very low wear or very low soiling as a result of the relatively infrequent use thereof, and thus has a longer service life. In theory, the adsorption container can be dispensed with completely, but this is out of the question because of various legal requirements and because of the lack of safety in the event of defects or unforeseen conditions in the fuel system.

In a preferred embodiment of the method according to the invention, the first and second opening pressures and the first and second closing pressures are determined by way of one, a plurality or all of the variables described in detail in the following. The starting point for the determination is a general target pressure inside the fuel tank, referred to in the following as the target pressure. This target pressure may vary as a function of the constructional configuration of the fuel tank. In the present pressure tank, a target pressure of just under the ambient pressure is desired, for example −0.05 bar. This and all other pressure specifications are given relative to the ambient pressure. −0.05 bar relative to atmospheric pressure, written in the following as bar(g), at approximately 1 bar absolute ambient air pressure, written in the following as bar(a), corresponds to 0.95 bar(a). Since ambient (air) pressure fluctuates by 1.013 bar(a), the absolute pressure specification is omitted as far as possible. −0.05 bar(g) advantageously ensures an underpressure in the fuel tank, meaning that volatile hydrocarbons, in other words the fuel vapour, cannot escape. Particularly preferably, the target pressure is adapted by way of the variables described in the following, so as to react to conditions present in the fuel system and the vehicle's environment and to make optimum fuel tank purging possible, the adsorption container not being or barely being made use of.

In principle, the following variables may be used in whole, in part or situationally not at all in specifying the opening and closing pressures. One option is to calculate them using a formula, starting from the current pressure inside the fuel tank and using each of the stated variables weighted as a correction factor. A preferred option would be to create a characteristic map which is created when applying the method according to an embodiment of the invention under the various conditions.

a) Operating Range of the Internal Combustion Engine

As already described, the internal combustion engine has to be in operation for it to be possible to switch to the first path of the three-way valve. This means that when the internal combustion engine is not in operation no first opening pressure and no first closing pressure are determined. If the internal combustion engine is in operation, for direct ventilation of the fuel tank into the suction duct, an operating range of the internal combustion engine has to be present which ensures a lower pressure of the suction duct with respect to the fuel tank. The pressure in the suction duct is dependent on the operating range, it being possible for a maximum underpressure of up to −0.8 bar(g) to occur when the throttle body is closed or almost closed at high rotational speeds (for example during coasting with zero load). At this underpressure, the fuel tank can be purged rapidly and to any desired target pressure. The first closing pressure can therefore be set to the target pressure of −0.05 bar(g). The first opening pressure could be anything above the first closing pressure by a minimum difference, making regular purging of the fuel tank into the suction duct possible and resulting in regulation of the internal pressure to the target pressure.

If the internal combustion engine is in a full-load operating range, the pressure in the suction duct is barely below the ambient pressure because of throttle losses. The first closing pressure should no longer be set to −0.05 bar(g), since there is a risk of backflow of fuel (vapour)/air mixture from the suction duct into the fuel tank, and this has to be prevented. A first closing pressure could be set to 0.05 bar(g), it being possible in turn for the first opening pressure to be anything above the first closing pressure by a minimum difference. Advantageously, the fuel tank is also purged at full load, but a lesser pressure reduction is achieved. Further, as a result purging of the fuel tank by way of the adsorption container can advantageously be dispensed with.

b) Fuel Temperature

The fuel temperature is detected by a unit for detecting the fuel temperature assigned to the fuel system. This unit can be arranged in the fuel tank, preferably at a distance from the opening of a fuel feedback, in a fuel conveying device, preferably the fuel high-pressure or injection pump, in a pressure reservoir for buffering fuel at high pressure or in the fuel feedback line. Since as fuel temperature increases the fuel evaporation rate and the saturated vapour pressure both increase, preventative purging of the fuel tank can be introduced for example in the fuel feedback line if a fuel temperature rise is detected. The first closing pressure can be reduced and can be closed to or less than the constructionally determined lower pressure limit, since fuel heating makes it likely that the lower pressure limit will be exceeded relatively quickly and thus no permanent underpressure will occur. Preferably, a constructionally determined lower pressure limit for long-term strength can be set, which may be fallen below briefly, as well as a constructionally determined lower pressure limit for short-term strength, which may not be fallen below even briefly. For example, the target pressure can be corrected downwards by 0.2 bar(g), meaning that the first closing pressure is set at −0.25 bar(g). To prevent backflow of the fuel (vapour)/air mixture into the fuel tank, the dependency on the operating range of the internal combustion engine should be observed. In this way, preventative fuel tank purging would only be possible at zero load. If there is a partial load which induces a pressure of for example −0.2 bar(g) in the suction system, the first closing pressure cannot turn out lower and would have to be set at for example −0.15 bar(g). The first opening pressure could be anything above the first closing pressure by a minimum difference.

c) Fuel Tank Fill Level

A fuel tank fill level is detected by a unit for detecting fuel tank fill level assigned to the fuel tank. As the fuel tank fill level decreases, the partial pressure of the air left in the fuel tank decreases. This results in a fall in the resulting internal pressure. However, the fuel present in the fuel tank continues to evaporate as a function of the existing partial pressure of the fuel tank, which is independent of the partial pressure of the air contained therein, the evaporation rate decreasing as the partial vapour pressure approaches the saturated vapour pressure. This in turn leads to a lesser increase both in the partial pressure of the fuel and in the resulting internal pressure. Thus, at a low fuel tank fill level, under the assumption that no additional air has arrived in the fuel tank, for example as a result of the underpressure valve in the tank being opened or of an incomplete refilling process, it can be assumed that the partial pressure of the air is lower and the increase in the pressure inside the fuel tank over time will thus turn out lower. This in turn makes it possible to raise the first and second opening pressures. Thus, on the one hand, purging is possible even in unfavourable operating ranges of the internal combustion engine. On the other hand, the first and second opening pressures can be set to such a high value that virtually no purging of the fuel tank takes place. This alternative can be selected if the fill-level-dependent partial pressure of the air plus the saturated vapour pressure of the fuel is less than the constructionally determined upper pressure limit of the fuel tank or if a fall in temperature is expected. A fall in temperature can cause the internal pressure to fall, primarily as a result of the strong dependence of the saturated vapour pressure on the temperature, meaning that the fuel tank is not at any risk of overpressure. Therefore, the first and second closing pressures should also not be selected too low. However, a rise in temperature can bring about a large rise in internal pressure. For these reasons, preferably at least two variables (temperature, fill level) should be considered.

d) Pressure Inside the Fuel Tank Gradient

A pressure inside the fuel tank gradient can be determined from the progression of the internal pressure over time. From the rise in the gradient, an expected internal pressure can be estimated. A large rise suggests early purging of the fuel tank, this being achieved by way of a reduced first opening pressure. A small rise can justify a delay to the purging and thus an increase in the first fuel tank opening internal pressure. In combination with the fuel temperature, the predictive power of the gradient can be increased. If the temperature has for example reached an empirically determined upper limit, for example 55° C., and the internal pressure is rising slightly, the first opening pressure can be set to or above a constructionally determined upper pressure limit, since a further increase in the internal pressure is not expected or not expected rapidly. If the fill level is additionally taken into account and is relatively low, because it is assumed that the partial pressure of the air in the fuel tank is relatively low, it can be assumed that the partial pressure of the fuel tank is approaching the saturated vapour pressure, which does not bring about any further pressure increase, greatly increasing the reliability of the prediction. Preferably, a constructionally determined upper pressure limit for long-term strength can be set, which may be exceeded briefly, as well as a constructionally determined upper pressure limit for short-term strength, which may not be exceeded even briefly.

e) Pressure Difference Between the Ambient Motor Vehicle Pressure and the Pressure Inside the Fuel Tank A pressure difference is determined between the ambient motor vehicle pressure, detected by a unit for detecting the ambient motor vehicle pressure assigned to the motor vehicle, and the internal pressure. This pressure difference makes it possible to correct the selected opening and closing pressures in accordance with fluctuating ambient pressures and makes more precise purging of the fuel tank to the target pressure possible.

f) Temperature Difference Between the Ambient Motor Vehicle Temperature and the Fuel Temperature A temperature difference is determined between the ambient motor vehicle temperature, detected by a unit for detecting the ambient motor vehicle temperature assigned to the motor vehicle, and the fuel temperature. The fuel in the fuel tank reacts relatively slowly to changes in the ambient temperature, depending on the amount of fuel in the fuel tank, in other words the fill level. Nevertheless, at a higher or lower ambient temperature it is possible to predict the development of the internal pressure, rising external temperatures also leading to an expectation of rising fuel temperatures, in turn leading to an increase in the saturated vapour pressure and the evaporation rate, causing the internal pressure to increase. Accordingly the first opening pressure would have to be reduced if temperature increases in the fuel tank were expected as a result of increased ambient temperatures, so as to make early purging of the fuel tank possible. If a very low ambient temperature and accordingly a large negative temperature difference are expected, and if this in combination with a high fuel tank fill level would lead to prediction of a low internal pressure, the first closing pressure can be raised so as to prevent the fuel tank internal pressure from falling below the constructionally determined lower pressure limit.

g) Air Proportion in the Fuel Tank

The air proportion in the fuel tank, determined by means of a signal which is provided by a sensing unit for detecting the oxygen content of an exhaust of the internal combustion engine and which represents the oxygen content of the exhaust, can likewise be used for correcting the determined opening and closing pressures or for increasing the predictive power of other variables. The air proportion in the fuel tank can be determined using a signal of a lambda probe. The air proportion makes it possible to draw conclusions concerning the predictive power of the fill level. At a low fill level, a relatively low air proportion is expected (rich air/fuel vapour mixture). If this is higher than expected, it may additionally be concluded, depending on the internal pressure progression, that there are leaks in the system, and the fuel tank fill level can either be used weighted to determine the opening and closing pressures or be excluded completely. A temperature/pressure progression of the fuel or the fuel tank can also be checked by way of the air proportion in the fuel tank. The air proportion in the tank also makes predictions possible as to the partial pressures of the air and the fuel vapour, whereupon the opening and closing pressures can be varied in turn as disclosed above.

h) Loading Level of the Adsorption Container

The loading level of the adsorption container is determined by means of a signal which is provided by a sensing unit for detecting the oxygen content of an exhaust of the internal combustion engine and which represents the oxygen content of the exhaust. The loading level of the adsorption container can be determined using the signal of the lambda probe. The loading level of the adsorption container has a significant effect on the second opening pressure and the second closing pressure. At a low loading level and when the internal combustion engine is not in operation, the purging of the fuel tank towards the adsorption container could be carried out even at a lower internal pressure. Since this would conflict with the aim of an embodiment of the present invention, to load the adsorption container as little as possible or not at all, the second opening pressure and the second closing pressure will be relatively high, whilst a low loading level will be able to lead to earlier purging. The purging into the adsorption container is preferentially carried out for unpredicted large rises in internal pressure. Moreover, the loading level of the adsorption container can provide a prediction as to the amount of previously adsorbed fuel vapour contents and thus a plausibility check for the remaining variables for determining the opening and closing pressures, and can thus be taken into account as a correction factor.

i) Fuel Used

Fuels are subject to fluctuation in composition. The saturated vapour pressure is dependent on the type of fuel, the octane number for benzene, the additives used by the oil companies, and the seasonal variation in the additives and compositions used. Additives and the composition can be classified by designating the oil company used for refilling. A designation of this type can be read out from a navigation system and/or a digital card during the filling process, for example using a geodetic position. More precise knowledge as to the expected saturated vapour pressure makes more precise prediction of the pressure progression in the fuel tank possible, meaning that the aforementioned variables can be taken into account more precisely in the determination of the opening and closing pressures.

j) Time Specification

By means of a time specification determined from a time of day or a date, future changes in the aforementioned variables can be predicted better. Thus, a decrease in the ambient temperature can be anticipated late in the evening and generally lower temperatures can be anticipated in winter, which lead to greater temperature differences and simultaneously to lower maximum temperatures (see above). Alternatively or in addition, a current weather report with a time specification or a weather forecast can be used to refine the prediction.

k) Number of Purging Processes Since Refilling

The number of purging processes carried out since the last refill is determined. In the simplest case, refilling can be determined by way of a rise in the fuel tank fill level, the fill level difference having to exceed a predetermined threshold. In general, detection methods for refilling processes are known. If a refilling process is detected, the air proportion in the tank can be determined using the new fill level, and this in turn makes conclusions possible as to the partial pressures of the air and the fuel vapour, and thus further predictions as to the rise in internal pressure.

Advantageously, most of the aforementioned variables are already detected in modern vehicles, and are thus available to a control unit of the aforementioned type, which determines the opening and closing pressures from the characteristic map or using the formula.

In one embodiment of the method according to the invention, depending on the loading level of the adsorption container and the operating range of the internal combustion engine, a blocking unit arranged in the fourth purging line and a further blocking unit arranged in the ambient line are opened to purge the adsorption container with ambient air towards the suction duct of the internal combustion engine. As disclosed previously, the loading level of the adsorption container is determined by means of the signal of the lambda probe. The loading level of the adsorption container can be classified in preferably three classes. A first class, which may for example be distinguished by a loading level less than or equal to 25%, makes regeneration or purging of the adsorption container possible, but does not necessitate it, and is classified as priority 3. A second class, preferably distinguished by a loading level between 25% and 75%, necessitates regeneration within an anticipatory fuel vapour purging strategy, but is classified as priority 2 in view of the remaining adsorption capacity. A loading level of preferably over 75% necessitates regeneration as rapidly as possible because of the low remaining adsorption capacity, and is therefore classified as priority 1. Further, the regeneration of the adsorption container is dependent on the operating range of the internal combustion engine. Most importantly, it must be in operation. Since the adsorption container cannot have an overpressure, but is always at the ambient pressure, the operating range must further provide a sufficiently large underpressure in the suction duct of the internal combustion engine. A minimum pressure difference between the suction duct and the ambient pressure should be ensured in this case since, on the one hand, because of throttle losses in the adsorption container the actual purging pressure therein is slightly less than the ambient pressure and, on the other hand, backflow of fuel vapour into the adsorption container has to be reliably prevented.

The priority of the respective class is related to the purging of the fuel tank. At priority 3, the fuel tank is purged if a fuel tank purging condition (reaching a first opening pressure) is met. At priority 2, the adsorption container can be purged even though a fuel tank purging condition is met, preferably if a difference between the internal pressure and the constructionally determined upper pressure limit does not exceed a predetermined threshold. At priority 1, the adsorption container is regenerated at the next opportunity (favourable operating range of the internal combustion engine). Advantageously, as a result a necessary regeneration (priority 1) is carried out, whilst at the same time a regeneration which is not absolutely necessary (priorities 2 and 3) is cancelled in favour of fuel tank purging, so as to prevent loading required in future of the adsorption container in an anticipatory manner.

Alternatively or in addition, the fuel tank and the adsorption container may be purged simultaneously, this being possible within a limited range of the internal pressure, in which case the internal pressure should be approximately at the ambient pressure so as to prevent backflow of fuel (vapour)/air mixture into the adsorption container and the fuel tank as a result of large pressure differences. Thus, the loading level of the adsorption container in connection with the operating range of the internal combustion engine is a variable for determining the first opening pressure. Further priority classes may be defined, for example a priority class 1a at a loading level over 90%, which is higher than priority 1 and at which an internal combustion engine is deliberately brought into a favourable operating range so as to regenerate the adsorption container. This measure is described in the following.

In an advantageous embodiment of the method according to the invention, if there is a signal to shut down the internal combustion engine, a decision is made as to whether or not the shutdown should be cancelled. This decision is made on the basis of the internal pressure and the second opening pressure. In addition or alternatively, the loading level of the adsorption container is used as a further basis for the decision. If the internal pressure is close to the second opening pressure, the decision can be made in favour of cancelling the shutdown, since purging into the adsorption container is immediately imminent if the internal combustion engine is shut down. The second opening pressure has thus been determined using further assumptions, for example the expected rise in temperature or the expected rise in pressure, as described above. If the loading level of the adsorption container is assigned a high priority of 1 or higher, the shutdown of the internal combustion engine may also be cancelled.

If the shutdown is to be cancelled, the throttle device in the suction duct of the internal combustion engine is almost or completely closed, so as to generate a relatively large underpressure in the suction duct. Subsequently, the three-way valve releases the first path for purging the fuel tank towards the suction duct. Alternatively or in addition, the blocking unit arranged in the fourth purging line and the further blocking unit arranged in the ambient line are opened so as to purge the adsorption container with ambient air towards the suction duct of the internal combustion engine. Once the conditions for cancelling the shutdown no longer apply (closing pressure inside the fuel tank reached and/or loading level classification decreased), the cancellation of the shutdown is suspended and the internal combustion engine is shut down. Advantageously, as a result the internal combustion engine can be kept in an optimum or favourable operating range for purging the fuel tank and/or the adsorption container, and a critical internal pressure and/or loading level can be eliminated. When the internal combustion engine is not in operation, alternatively or in addition the internal combustion engine can be set in operation at a critical internal pressure and/or loading level of the adsorption container. Advantageously, as a result unpredicted and/or unpredictable critical states can be eliminated and the escape of fuel vapours can be effectively prevented. The resulting loss of overall efficiency is more than compensated by the prevention of structural damage to the fuel tank and the prevention of unburnt hydrocarbons from escaping from the fuel system.

An embodiment of the present invention comprises a device for purging the fuel tank. This comprises units for detecting the pressure inside the fuel tank, the fuel tank fill level, the fuel temperature, the position of the throttle device, the rotational speed of the internal combustion engine, the ambient motor vehicle temperature and the oxygen content of the exhaust. The device also comprises an adsorption container for adsorbing fuel vapours. Preferably, the adsorption container is an activated carbon container. The device further comprises a control unit at least for receiving the signals emitted by the units. The control unit determines the operating range of the internal combustion engine on the basis of the throttle device position signal and the rotational speed signal. The control unit further determines the loading level of the adsorption container and the air proportion in the fuel tank on the basis of the exhaust oxygen signal. This preferably takes place by way of serial purging of the fuel tank and the adsorption container, and can take place once and be adapted, in other words updated, for each purging of the fuel tank into the suction duct and the adsorption container. On the basis of at least one of the received signals, of the operating range of the internal combustion engine, of the loading level of the adsorption container and/or of the air proportion in the fuel tank, a first and a second opening pressure inside the fuel tank and a first and a second closing internal pressure are determined by the control unit.

The device further comprises a three-way valve which has three terminals. The fuel tank is in a fluid connection with the first terminal of the three-way valve via a first purging line. The second terminal of the three-way valve is in a fluid connection with the suction duct of the internal combustion engine via a second fuel line, the second fuel line opening into the suction duct downstream from the throttle device. The third terminal of the three-way valve is in a fluid connection with the adsorption container via a third purging line. A fourth purging line makes a fluid connection possible between the adsorption container and the suction duct, the fourth purging line likewise opening into the suction duct downstream from the throttle device, preferably upstream from the opening of the second purging line. The fourth purging line can be blocked off by means of a blocking unit. Blocking units of this type can block the purging line off tightly in the form of a solenoid valve or the like. A fluid connection is established between the adsorption container and the motor vehicle environment via an ambient line. Like the fourth purging line, this can be blocked off tightly using a further blocking unit.

The three-way valve has three paths. The first path connects the first and the second terminal, establishing a fluid connection between the fuel tank and the suction duct. Switching to the first path is carried out by an adjustment unit assigned to the three-way valve. This unit in turn receives an adjustment signal from the control unit. The adjustment signal is triggered by the control unit when the internal pressure exceeds the first opening pressure. The second path of the three-way valve connects the first and the third terminal, establishing a fluid connection between the fuel tank and the adsorption container. The switching is carried out by the adjustment unit, which receives an adjustment signal from the control unit, this signal being triggered by the control unit when the internal pressure exceeds the second opening pressure. The third path is a blocked position, in which there are no fluid connections between the terminals. This path can be switched to passively, automatically, when an adjusting force from the adjustment unit is removed, as is usual with spring-loaded solenoid valves. Alternatively, the adjustment unit can actively switch to the path. In either case, the control unit triggers the switching. This takes place either by removing the aforementioned adjustment signals or by triggering a new adjustment signal. Both alternatives (removing the old adjustment signal and triggering a new one) are triggered as a result of the internal pressure falling below the first or second closing pressure. Advantageously, the device according to an embodiment of the invention makes the method according to an embodiment of the invention possible and provides a fuel tankpurging system which makes minimum use of the adsorption container possible.

In an embodiment of the device according to the invention, a mechanical supercharger is arranged in the suction duct downstream from the opening of the second and fourth purging lines. Mechanical superchargers comprise compressors and turbochargers. So as not to limit the efficiency of the supercharger, the combustion air should be available on the suction side thereof with minimum throttling. For this reason, and because the throttle device upstream from the openings is no longer suitable for regulating the volume of combustion air, said device is fully open as a rule. Just for selectively producing an underpressure at the openings of the second and fourth purging lines, the throttle device may be almost or completely closed. To regulate the volume of combustion air, in this development a further throttle device, for example a further throttle body, is arranged in the suction duct downstream from the mechanical supercharger. The person skilled in the art will appreciate that the throttle device may also be formed by a device for variable valve control, meaning that the inlet valves of the internal combustion engine are only opened to an extent and for a duration required for the current operating range. This embodiment of the invention has an effect on the method according to an embodiment of the invention. The purging operating range of the internal combustion engine thus changes from a predetermined variable to a parameter which can be actively influenced, and which has to be set selectively (e.g., this is achieved by cancelling the shutdown of the internal combustion engine).

FIG. 1 schematically shows a fuel system 1 of a motor vehicle comprising an internal combustion engine 18. A fuel tank 2 comprises a pressure sensor 5, a temperature sensor 21 and a fill level sensor 20. These supply an internal pressure signal, a fuel temperature signal and a fuel level signal, for the fuel 3 located in the fuel tank 2, to a control unit. A suction duct 15 and an exhaust duct 16 are assigned to the internal combustion engine 18. A throttle body 14 is arranged in the suction duct 15 and sets the volume flow of the combustion air supplied to the internal combustion engine 18. The position of the throttle body 14 is controlled by the control unit itself as a function of a driver of the motor vehicle or otherwise detected and transmitted to the control unit. At least one lambda probe 17 is assigned to the exhaust duct 16, and detects the oxygen proportion in the exhaust and transmits it to the control unit as an oxygen exhaust signal.

In the fuel tank 2, as well as the fuel 3 there is also a fuel vapour/air mixture 4, also referred to in the following as fuel vapour 4. A first purging line 7 branches off from the upper region, filled with fuel vapour 4, of the fuel tank 2. This line is connected to a first terminal of a three-way valve 19. The three-way valve 19 comprises a second and a third terminal. The second terminal is connected to a second rising line 8, which in turn opens into the suction duct 15 downstream from the throttle body 14. The third terminal is connected to a third purging line 9 which opens into an activated carbon container 11. This is in turn connected to the suction duct 15 via a fourth purging line 10, the fourth purging line 10 opening into the suction duct 15 between the throttle body 14 and the opening of the second purging line 8, and being blocked off by a stop valve 12. The activated carbon container 11 comprises an ambient line 22 which has a further stop valve 13.

The three-way valve 19 can release three paths by means of an adjustment device which is actuated by the control unit. The first path connects the first purging line 7 to the second purging line 8 and thus establishes a fluid connection between the fuel tank 2 and the suction duct 15. The second path connects the first purging line 7 to the third purging line 9 and thus establishes a fluid connection between the fuel tank 2 and the adsorption container 11.

Figure 2:
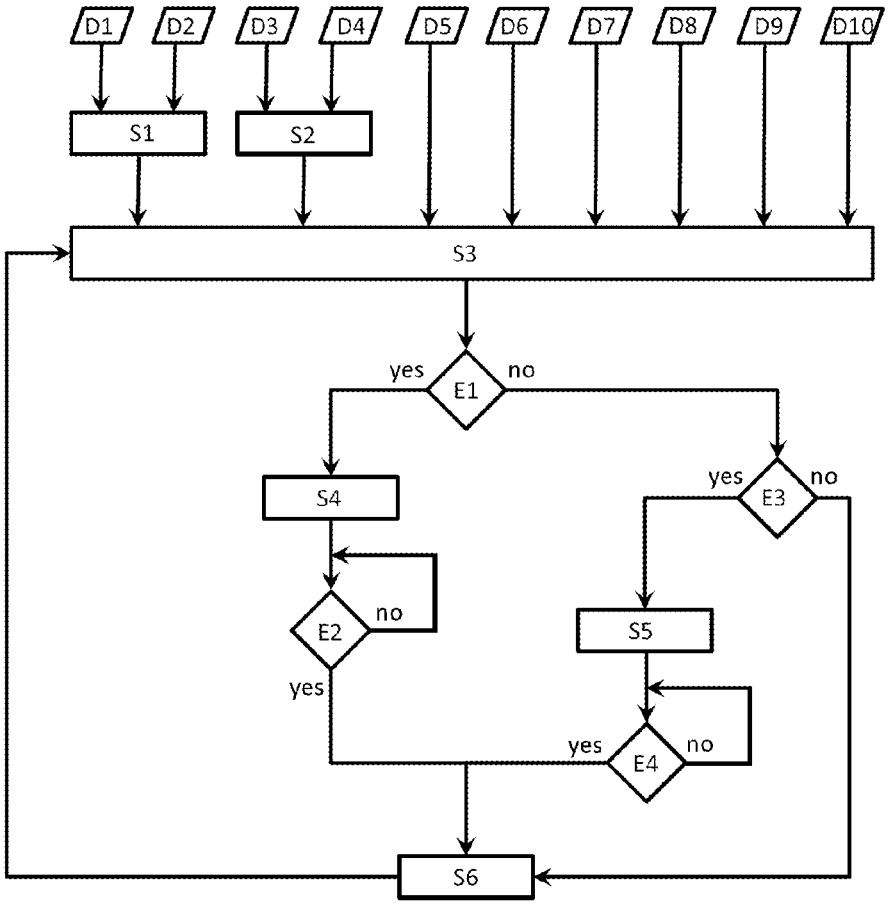
FIG. 2 is a flow chart for controlling the fuel tank purging in accordance with an embodiment of the invention.

The flow chart of FIG. 2 shows the determination of the adjustment signals for the adjustment device by the control unit. The input signals D1 to D10 are detected constantly at the provided detection frequency. In the first step S1, the operating range of the internal combustion engine is determined from the variables of rotational speed D1 of the internal combustion engine and throttle body position D2. In the second step S2, the loading level of the activated carbon container and the air proportion in the fuel tank are determined from the variables of oxygen content in the exhaust D3 and pressure inside the fuel tank D4. The operating range, loading level, air proportion and internal pressure D4 are used together with the further variables of fuel temperature D5, fuel tank fill level D6, ambient temperature D7, ambient pressure D8, a time specification D9 and the number of purging processes since refilling D10 to determine the first and second opening pressures and the first and second closing pressures. Further variables, such as the current fuel injection amount, are already known to the control unit or can be queried. Next, in E1, the internal pressure D4 is compared with the first opening pressure. If the condition E1 $p_{Innen} \geq p_{1.ÖD}$ is met, in step S4 the first path of the three-way valve 19 is released, causing the fuel vapours 4 to be purged towards the suction duct 15. If the condition is not met, in E3 the internal pressure D4 is compared with the second opening pressure. If the condition E1 $p_{Innen} \geq p_{2.ÖD}$ is met, in step S5 the second path of the three-way valve 19 is released, causing the fuel vapours 4 to be purged towards the activated carbon container 11. If the first path was opened in S4, in E2 the internal pressure D4 is subsequently compared with the first closing pressure. If the condition E2 $p_{Innen} \leq p_{1.SD}$ is met, in step S6 the three-way valve 19 is placed in the closed state, in other words in the blocked position. Subsequently, the opening and closing pressures are determined again in S3, the current values of the aforementioned variables being used in the determination. If the condition E2 is not met, the internal pressure D4 is continuously compared with the first closing pressure until the condition is met. If the second path was opened in S5, in E4 the internal pressure D4 is subsequently compared with the second closing pressure. If the condition E4 $p_{Innen} \leq p_{2.SD}$ is met, in step S6 the three-way valve is placed in the closed state, in other words in the blocked position. Subsequently, the opening and closing pressures are determined again in S3, the current values of the aforementioned variables being used in the determination. If the condition E4 is not met, the internal pressure D4 is continuously compared with the second closing pressure until the condition E4 is met. If the condition E3 is not met, in step S6 the three-way valve 19 is kept in the closed state, in other words the blocked position, so as subsequently to jump back to step S3.

Figure 3A:
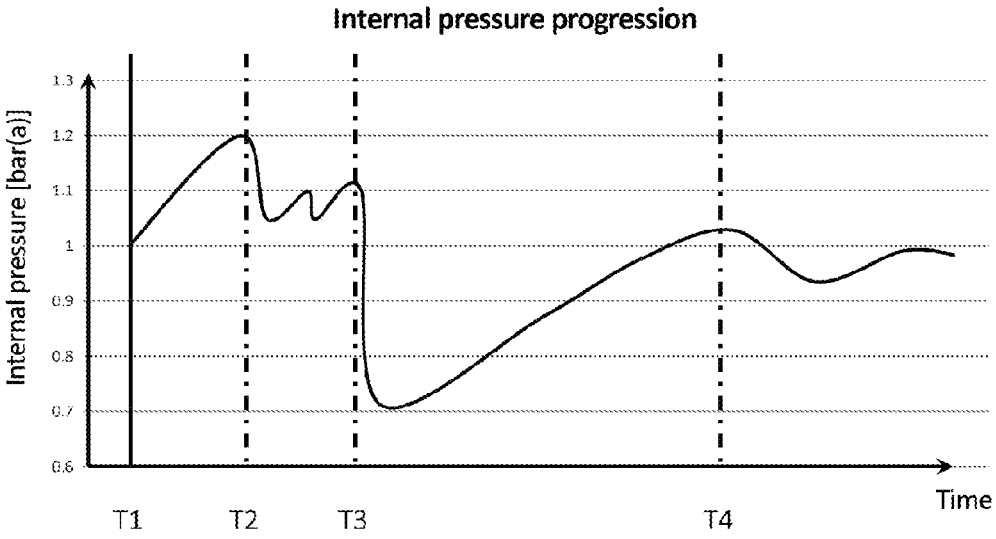
FIGS. 3 A and B consist of two graphs showing possible pressure progressions in a fuel tank regulated by the method according to an embodiment of the invention.
Figure 3B:
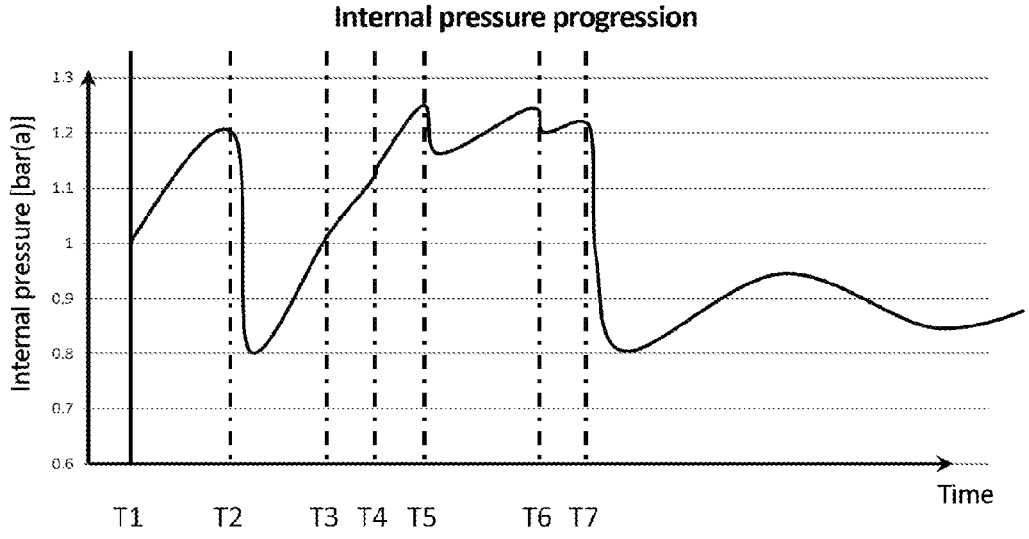

FIGS. 3*a* and 3*b* schematically show the progression of the internal pressure D4 over time using two different scenarios.

In FIG. 3*a*, refilling takes place at time T1. As a result of the pressure compensation during refilling, the internal pressure D4 is set to ambient pressure D8, preferably by suction by the nozzle of the fuel vapours 4 displaced by inflowing fuel 3. The ambient pressure D8 is taken as 1 bar(a). Because of the evaporation of the fuel 3, the internal pressure D4 in the fuel tank 2 increases. It can be assumed that the vehicle is driven by electric motor after the refilling process until time T2. The second opening pressure, which is for example 1.25 bar(a), is not reached, meaning that the fuel tank 2 is not purged. At time T2, the internal combustion engine 18 is set in operation at full load, for example on a motorway journey. The first opening pressure is determined as 1.2 bar(a). The three-way valve 19 thus opens the first path and the fuel vapours 4 are purged into the suction duct 15. Since at full load there is a very small underpressure in the suction duct 15, the first closing pressure is set to 1.05 bar(a). Until time T3, the operating range does not change. At T3, the motorway journey ends and the internal combustion engine 18 receives a signal to shut down. At this point it is for example a summer morning, and because of this and because of the heated fuel 3 of the fuel backflow, the control unit anticipates a further rise in pressure in the internal pressure D4. At time T3, this is 1.1 bar(a), whereupon the control unit makes the decision to cancel the shutdown of the internal combustion engine 18. Subsequently, the internal combustion engine 18 continues idling, resulting in large negative pressure in the suction duct 15. The first opening pressure is set to the present 1.1 bar(a), and the first closing pressure is set to 0.7 bar(a), for example corresponding to the constructionally determined lower pressure limit, so as to counter the anticipated pressure rise with maximum purging. The fuel vapours 4 are thus purged into the suction duct 15. During this purging, the oxygen content in the exhaust D3 is detected by the lambda probe 17. On the basis of this variable, the air proportion in the fuel tank 2 is determined as follows. The volume flow of fuel vapour/air mixture 4 flowing into the suction duct 15 is determined using the fall in pressure in the fuel tank 2 and the current gas volume (total volume of fuel tank 2 minus fill level D6). For a defined fuel injection amount into the internal combustion engine 18 (almost zero during idling), the fuel vapour/air ratio in the fuel vapour/air mixture 4 can be determined using the oxygen proportion in the exhaust D3. Since the evaporated amount of fuel 3 during the purging period is negligible, the air proportion in the fuel tank 2 is known. Using the gas volume in the fuel tank 2 and the air proportion, the partial pressure of the available air (for example 0.4 bar(a)) and the partial pressure of the fuel vapour 4 (for example 0.3 bar(a)) as a difference from the internal pressure D4 can be determined. The temperature-dependent saturated vapour pressure of the fuel is likewise known. Thus, the expected rise in pressure can be determined as a function of the expected rise in temperature. As a result, the internal pressure D4 continues to rise until the saturated vapour pressure of the fuel 3 is reached, for example at time T4. Subsequently, the internal pressure D4 only continues to fluctuate as a function of the temperature D5 of the fuel 3 or of the environment D7, and no further tank ventilation is necessary unless extreme conditions occur.

In FIG. 3*b*, refilling is also carried out at time T1. The internal pressure D4 rises as a result of the evaporation of fuel 3. The second opening closing pressure is for example 1.25 bar(a) as above. From time T2, the internal combustion engine 18 is briefly operated at a partial load. Because no purging has yet taken place since the refilling process, the control unit decides to purge to the maximum possible extent. Because of the partial load operating range of the internal combustion engine 18, the first closing pressure is set to 0.8 bar(a). Subsequently, fuel 3 continues to evaporate, but at a decreasing evaporation rate, because the partial pressure approaches the saturated vapour pressure. The reduced rise after time T3 is shown schematically. At time T4, on the basis of received weather data predicting a fall in temperature and because of the reduced rise in internal pressure D4 (low pressure gradient), the control unit decides not to purge. Moreover, it is determined using a calendar that very low temperatures will occur (for example overnight) in the current month (for example January), and as a result the received weather report is deemed plausible and the weighting thereof is increased. Now, at time T4, the internal combustion engine 18 is briefly operated at full load. The temperature D5 of the fed-back fuel 3 is not high enough to revise the previous decision based on the weather report, the low rise in pressure and the expected very low temperatures. Subsequently, the motor vehicle is parked in an underground car park, which has an increased ambient temperature D7. Overall, however, the increased ambient temperature D7 and the temperature D5 of the fed-back fuel 3 lead to a large rise in pressure in the fuel tank 2. However, this is no longer taken into account in the decision to cancel the shutdown of the internal combustion engine 18, since the vehicle has already been parked. The internal pressure D4 continues to rise until the second opening pressure (for example 1.25 bar(a)) is reached at time T5. The three-way valve 19 now opens the second path and the fuel vapour 4 is purged into the activated carbon container 11. The air purified in the activated carbon container 11 is emitted to the environment via the ambient line 22. Thus, either the further blocking unit 13 can be opened or an overpressure valve arranged in the ambient line 22 or in the further blocking unit 13 opens. Because of the relatively large pressure gradient which is now taken into account in determining the second closing pressure, the second closing pressure is set to 1.15 bar(a). If the internal pressure D4 is reduced to 1.15 bar(a), the three-way valve 19 closes the second path again. The internal pressure D4 rises as a result of the continuing evaporation of the fuel 3, but with a much smaller rise. The second opening pressure remains set at 1.25 bar(a), but the second closing pressure is increased to 1.2 bar(a) because of the lower rise/pressure gradient. At time T6, there is further purging into the activated carbon container 11. At time T7, the motor vehicle is set in operation again. Because of the relatively high internal pressure D4 of approximately 1.23 bar(a), the control unit decides to cancel the shutdown of the internal combustion engine 18 if it has been in operation briefly, or even to set the internal combustion engine 18 in operation if it is not in operation. This decision can be made on the basis of the high loading level of the activated carbon container 11 reached overnight in the underground car park, which has been updated from an original loading level using the eliminated internal pressure D4 and the related flow rate of fuel vapour/air mixture 4, for example if this level exceeds a threshold which calls for a highest priority. In the subsequent operating range of the internal combustion engine 18 (partial load or idling), the activated carbon container 11 is regenerated and the fuel tank 2 is purged towards the suction duct 15. The necessary first closing pressure is not set to the constructionally determined lower pressure limit, because on the one hand the determined air proportion in the fuel tank 2 has already fallen to a value which corresponds to a partial pressure of the air which does not necessitate any further purging and/or because the further expected fall in pressure due to the further expected cold ambient temperatures D7 should not cause the internal pressure D4 to fall below the constructionally determined lower pressure limit. Thus, after the purging process in T7, no further purging is necessary and the internal pressure D4 only continues to fluctuate because of fluctuating fuel and ambient temperatures D5 and D7.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE NUMERALS 1 fuel tank system
2 fuel tank
3 fuel
4 fuel vapour/air mixture
5 pressure sensor
6 underpressure valve
7 first purging line
8 second purging line
9 third purging line
10 fourth purging line
11 activated carbon container
12 stop valve
13 further stop valve
14 throttle body
15 suction duct
16 exhaust duct
17 lambda probe
18 internal combustion engine
19 three-way valve
20 fill level sensor
21 temperature sensor
22 ambient line
D1 ICE rotational speed
D2 throttle body position
D3 exhaust oxygen content
D4 pressure inside the fuel tank
D5 fuel temperature
D6 fuel tank fill level
D7 ambient temperature
D8 ambient pressure
D9 time specification
D10 number of purging processes since refilling
S1 Determine ICE operating range
S2 Determine adsorption container loading level/fuel tank air proportion
S3 Determine opening and closing pressures
S4 Release first path of three-way valve
S5 Release second path of three-way valve
S6 Close/Keep closed first and second path of three-way valve
E1 Compare internal pressure with first opening pressure
E2 Compare internal pressure with first closing pressure
E3 Compare internal pressure with second opening pressure
E4 Compare internal pressure with second closing pressure

What is claimed is:

1. A method for purging a fuel tank arranged in a motor vehicle, the method comprising: providing a three-way valve having first, second and third terminals, the first terminal being connected to the fuel tank via a first purging line, the second terminal being connected to a second purging line which opens into a suction duct of an internal combustion engine disposed downstream from a throttle device, the third terminal being connected to a third purging line which opens into an adsorption container configured to adsorb fuel vapours, the adsorption container being connected to a fourth purging line which is lockable and which opens into the suction duct, the adsorption container being further connected to an environment of the vehicle via a lockable ambient line so as to release air freed from fuel vapours and to receive ambient air;

determining, by a unit associated with the fuel tank and configured to detect an internal fuel tank pressure of the fuel tank, the pressure inside the fuel tank;

releasing a first path in the three-way valve, based on the pressure inside the fuel tank exceeding a first predetermined opening pressure inside the fuel tank and the internal combustion engine being in operation, such that the first and second terminals are connected and cause the fuel vapours to be purged out of the fuel tank into the suction duct via the first and second purging lines, the first path being closed again based on the pressure inside the fuel tank falling below a first predetermined closing pressure inside the fuel tank; and releasing a second path in the three-way valve, based on the pressure inside the fuel tank exceeding a second predetermined opening pressure inside the fuel tank and the internal combustion engine being not in operation, such that the first and third terminals are connected and cause the fuel vapours to be purged out of the fuel tank into the adsorption container via the first and third purging lines, the second path being closed again based on the pressure inside the fuel tank falling below a second predetermined closing pressure inside the fuel tank.

2. The method according to claim 1, further comprising determining the first and second opening pressures inside the fuel tank and the first and second closing pressures inside the fuel tank as a function of at least one the following variables:

an operating range of the internal combustion engine;

a fuel temperature as detected by a unit associated with the fuel system and configured to detect the fuel temperature of the fuel system;

a fuel tank fill level as detected by a unit associated with the fuel tank and configured to detect the fuel tank fill level of the fuel tank;

a fuel tank internal pressure gradient as determined from a progression of the pressure inside the fuel tank over time;

a pressure difference between an ambient motor vehicle pressure, as detected by a unit associated with the motor vehicle and configured to detect the ambient motor vehicle pressure of the vehicle, and the pressure inside the fuel tank;

a temperature difference between an ambient motor vehicle temperature, as detected by a unit associated with the motor vehicle and configured to detect the ambient motor vehicle temperature of the vehicle, and the fuel temperature;

an air proportion in the fuel tank as determined using a signal which represents an oxygen content of an exhaust of the internal combustion engine and is provided by a sensing unit configured to detect the oxygen content of the exhaust;

a loading level of the adsorption container as determined using the signal which represents the oxygen content of the exhaust and is provided by the sensing unit configured to detect the oxygen content of the exhaust;

fuel used;

a time specification as determined from a time of day, date or season; and a number of purging processes after a refill.

3. The method according to claim 2, further comprising opening a blocking unit disposed in the fourth purging line and a further blocking unit disposed in the ambient line, based on the loading level of the adsorption container and the operating range of the internal combustion engine, so as to purge the adsorption container with ambient air towards the suction duct of the internal combustion engine.

4. The method according to claim 3, further comprising, based on a signal to perform a shutdown of the internal combustion engine, the following steps:

determining whether to cancel the shutdown of the internal combustion engine based on the pressure inside the fuel tank and the second opening pressure inside the fuel tank or the loading level of the adsorption container, closing or almost closing the throttle device, where it is determined to cancel the shutdown, so as to generate a relatively large underpressure in the suction duct downstream from the throttle device;

releasing the first path in the three-way valve so as to purge the fuel tank towards the suction duct or releasing the blocking units disposed in the fourth purging line and in the ambient line so as to purge the adsorption container with ambient air towards the suction duct of the internal combustion engine;

blocking the first path in the three-way valve or closing the blocking units disposed in the fourth purging line and in the ambient line based on the pressure inside the fuel tank and the first closing pressure inside the fuel tank or the loading level of the adsorption container, and continuing the shutdown of the internal combustion engine.

5. A device for purging a fuel tank arranged in a motor vehicle, the device comprising:

a first unit associated with the fuel tank and configured to detect an internal fuel tank pressure of the fuel tank, the first unit being configured to emit a signal representing the pressure inside the fuel tank;

a second unit associated with the fuel tank and configured to detect a fuel tank fill level of the fuel tank, the second unit being configured to emit a signal representing the fuel tank fill level;

a third unit associated with a fuel system and configured to detect a fuel temperature of the fuel system, the third unit being configured to emit a signal representing the fuel temperature;

a fourth unit associated with a throttle device and configured to detect a throttle device position of the throttle device disposed in a suction duct of an internal combustion engine of the motor vehicle, the fourth unit being configured to emit a signal representing the throttle device position;

a fifth unit associated with the internal combustion engine and configured to detect a rotational speed of the internal combustion engine, the fifth unit being configured to emit a signal representing the rotational speed of the internal combustion engine;

a sixth unit associated with the motor vehicle and configured to detect an ambient motor vehicle temperature of the motor vehicle, the sixth unit being configured to emit a signal representing the ambient motor vehicle temperature;

a sensing unit associated with an exhaust duct and configured to detect an oxygen content of an exhaust of the exhaust duct which removes the exhaust from the internal combustion machine, the sensing unit being configured to emit a signal representing the oxygen content of the exhaust;

an adsorption container configured to adsorb fuel vapours;

a control unit, configured to receive at least the signals representing the pressure inside the fuel tank, the fuel tank fill level, the fuel temperature, the throttle device position, the rotational speed of the internal combustion engine, the ambient motor vehicle temperature and the oxygen content of the exhaust, the control unit being configured to determine an operating range of the internal combustion engine based on the signals representing the throttle device position and the rotational speed of the internal combustion engine, the control unit being configured to determine an air proportion in the fuel tank and a loading level of the adsorption container based on the signal representing the oxygen content of the exhaust, and the control unit being configured to determine a first and a second opening pressure inside the fuel tank and a first and a second closing fuel tank pressure based on at least one of the signals, the air proportion in the fuel tank, the loading level of the adsorption container or the operating range of the internal combustion engine;

a three-way valve having first, second and third terminals, a first purging line being arranged as a fluid connection between the fuel tank and the first terminal, a second purging line being arranged as a fluid connection between the second terminal and the suction duct downstream from the throttle device, and a third purging line being arranged as a fluid connection between the third terminal and the adsorption container, wherein the three-way valve is switchable between first, second and third paths, the first path being a fluid connection between the first and the second terminal and the three-way valve being switched to the first path based on the first opening pressure inside the fuel tank and the pressure inside the fuel tank, the second path being a fluid connection between the first and the third terminal and the three-way valve being switched to the second path based on the second opening pressure inside the fuel tank and the pressure inside the fuel tank, and the third path being a block in which no fluid connection exists between the first, second and third purging lines;

a fourth purging line arranged as a fluid connection between the adsorption container and the suction duct downstream from the throttle device, the fourth purging line being blockable using a blocking unit; and an ambient line arranged between the adsorption container and an environment of the motor vehicle, the ambient line being blockable using a further blocking unit.

6. The device according to claim 5, further comprising:

a mechanical supercharger arranged in the suction duct of the internal combustion engine downstream from openings of the second and fourth purging lines; and a further throttle device arranged in the suction duct of the internal combustion engine downstream from the mechanical supercharger.

* * * * *